United States Patent [19]

Honigsbaum

[11] Patent Number: 4,976,202

[45] Date of Patent: Dec. 11, 1990

[54] ANTITANK-ANTIPERSONNEL WEAPON

[76] Inventor: Richard F. Honigsbaum, 245 Passaic Ave., Passaic, N.J. 07055

[21] Appl. No.: 200,702

[22] Filed: May 31, 1988

[51] Int. Cl.[5] ..... F42B 13/46

[52] U.S. Cl. ..... 102/367; 102/302; 102/328; 102/512

[58] Field of Search ..... 102/302, 328, 512, 367, 102/440

[56] References Cited

U.S. PATENT DOCUMENTS

| | | | |
|---|---|---|---|
| 3,599,210 | 8/1971 | Stander | 343/18 A |
| 3,713,383 | 1/1973 | Crescenzo et al. | 102/512 X |
| 3,980,023 | 9/1976 | Misevich | 102/512 X |
| 4,284,326 | 8/1981 | Durrer | 350/63 |
| 4,598,096 | 7/1986 | Grant | 102/512 X |
| 4,726,291 | 2/1988 | Lefranc | 102/214 |

OTHER PUBLICATIONS

Weapons, The Diagram Group, St. Martin's Press, New York, 1980, pp. 231, 268 and 277.

Jane's Infantry Weapons, 1987–1988, pp. 445, 463, 471, 500, 502, Glossary.

Jane's Armour and Artillery 1981–1982, pp. 84–88, 648–849, 800.

Jane's Publishing Company, Ltd., London, England.

Jane's Weapons Systems, 1987–1988, pp. 415–416.

Jane's Military Vehicles and Ground, Support Equipment, 1984, pp. 205–206, 209, 697.

*Primary Examiner*—Peter A. Nelson

*Attorney, Agent, or Firm*—Schechter, Brucker & Pavane

[57] ABSTRACT

The antitank-antipersonnel weapons of this invention are synergistic combinations of lens-compromising agents, radar-compromising agents, and human irritants.

The lens-compromising agents opaque the external lenses of tank periscopes and gunsights, and the radar-compromising agents block radar signals, forcing tank crews to navigate tanks and aim weapons by direct observation through open hatches, and to don "gas" masks for protection against the human irritants.

The lenses of protective masks are also opaqued by the weapons of this invention, and when they are, tanks, tank crews, and other personnel are functionally blind and unable to fight.

25 Claims, No Drawings

ANTITANK-ANTIPERSONNEL WEAPON

BACKGROUND OF THE INVENTION

1. Field of the Invention

This invention relates to antitank-antipersonnel weapons and more particularly to antitank-antipersonnel weapons that are synergistic combinations of lens-compromising agents, radar-compromising agents, and human irritants.

2. Prior Art

The primary weapons of this invention are derived from hand grenades and land mines, primitive versions of which have been used as instruments of war for centuries. These primitive weapons and their more modern counterparts are described in some detail in *Weapons*, The Diagram Group, St. Martin's Press, New York 1980.

The grenades, mines, projectiles, bombs, etc. that are modified to become the weapons of this invention, as well as the tank optics, radars, and protective masks that will be compromised by the weapons of this invention are described, for example, in *Jane's Infantry Weapons* 1987–88, *Jane's Weapons Systems* 1987–88, *Jane's Military Vehicles and Ground Support Equipment* 1984, and *Jane's Armour and Artillery* 1981–82.

The human irritants needed to practice this invention and known from prior use range from the relatively benign capsicum derivatives found in personal protection sprays such as "Halt!", through the incapacitating agents chloracetophenome (CN), O-chlorobenzolmalonitrile (CS), and diphenylaminochloroarsine (DM), to the World War I gases mustard and phosgene. These human irritants, along with the older "germ warfare" dusts and aerosols, have been described in detail in medical journals, as have their short and long term physiological effects, and where known, their antidotes.

The lens-compromising agents needed to practice this invention are well known products that are used for other purposes. One such product is conducting paint that can also serve in the present invention as one kind of radar-compromising agent. Another kind of radar-compromising agent that may be needed to practice this inventin is a radar absorbing material such as that disclosed in Stander, U.S. Pat. No. 3,599,210.

Finally, a tank periscope lens purging arrangement disclosed by Durer, U.S. Pat. No. 4,284,326, and in which a stream of purging air is blown over the external lens of the periscope, is an example of one kind of potential countermeasure that must be addressed if the weapons of this invention are to be effective.

SUMMARY OF THE INVENTION

According to the present invention, I have synergistically combined lens-compromising agents, human irritants, and, where appropriate, radar-compromising agents for use as antitank-antipersonnel weapons.

According to one preferred embodiment of the invention, the lens-compromising agents, such as abradants, etchants, opaquants and/or solvents, are packaged in frangible capsules that are, in turn, packaged in riot-type grenades along with igniters, human irritants, and propelling charges. These grenades are thrown at, launched toward, or dropped on their intended targets, and release their human irritants and propel the capsules toward their target lenses upon impact, or after a present time delay.

The lens-compromising agents opaque the external lenses of tank periscopes and gunsights, and the radar compromising agents block radar signals, forcing tank crews to navigate tanks and aim weapons by direct observation through open hatches, and to don "gas" masks for protection against the human irritants.

The lenses of the protective masks are also opaqued by the weapons of this invention, and when they are, tanks, tank crews, and other personnel are functionally blind and unable to fight.

According to another preferred embodiment of this invention, the lens-compromising agents, human irritants, and, where appropriate, radar-compromising agents, in capsules or otherwise, are packaged in land mines.

According to yet other preferred embodiments of this invention, these grenades and/or mines are packed into and delivered by projectiles, bombs, or rockets.

This invention offers many advantages over prior-art weaponry, the most important of which is a level of effectiveness that is not compromised by making the weapon nonlethal.

This and other advantages, features, and modifications are explored more fully in the annexed drawings and the detailed descriptions of the preferred embodiments that follow. These drawings and descriptions are intended as illustrative, and not as limiting with respect to this invention.

BRIEF DESCRIPTIONS OF THE DRAWINGS

DETAILED DESCRIPTION OF THE PREFERRED EMBODIMENTS

Figure 1:
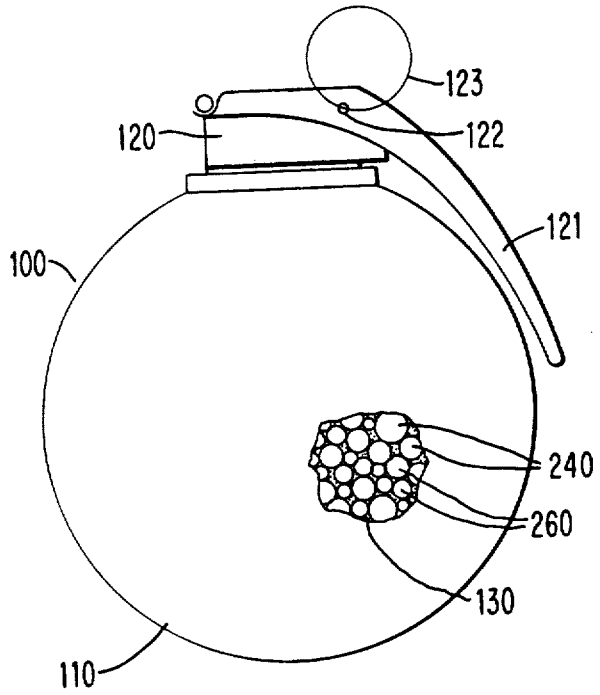
FIG. 1 is a diagrammatic view, partially broken away, of a grenade in accordance with the present invention.

The embodiment of FIG. 1 is a modified hand grenade 100. This embodiment is derived from the U.S. Army Comboball Grenade and retains all of the features of that weapon excepting the loading, and is preferred because it facilitates early deployment of this invention. Components familiar from the existing weapon are the soft thin rubber body 110, the conventional Bouchon igniter 120 with fly-off lever 121, safety pin 122, pin ring 123, and a propelling charge (not shown). The powdered irritant 130 of the existing weapon is retained, but the rubber pellets of the existing weapon are replaced by frangible capsules holding the lens-compromising agents, the radar compromising agents, and the human irritants as needed to practice this invention, such as the capsules 240 of FIG. 2, 260 of FIG. 2B, etc. that are more fully described later herein.

The targets of the weapons of this invention are tanks, tank crews, and other personnel. These FIG. 1 grenades are hurled at their targets in the conventional way, and, assuming the throw to be good enough so that the grenades are a few yards ahead of the tanks when they explode, at least some of the frangible capsules will be propelled toward and impact upon external tank optics, whereupon they will break, release their contents, and compromise these optics.

Suitable lens-compromising agents include abradants such as sharp grits and sands, etchants such as fluoride gels, opaquants such as lacquers and paints, and solvents such as acetone, xylene, etc. These agents, packaged in separate capsules or in compatible combinations that may include human irritants, compromise tank optics by their respective effects, and when enough such impacts have occurred, tanks can no longer be navigated and their guns no longer aimed on the basis of information provided by these optics so that these functions, if they are to be performed at all, must be performed by direct observation by tank crews peering through open hatches.

The human irritants force tank crews to wear protective masks, and the lenses of these masks, exposed to the lens-compromising agents when tank crews substitute direct observation for compromised tank optics, are also compromised by these agents. Thus, when tank optics and protective mask lenses are so compromised, and the human irritants are also eye irritants as preferred, tank crews are at least temporarily blinded and unable to operate their tanks or weapons despite protective masks, tank-supplied or self contained air supplies, etc.

This weapon is also effective against personnel that are on foot, in other vehicles, in bunkers, etc., and have as their very important advantage over prior-art weapons full effectiveness on a nonlethal basis. (The matter of lethality can, of course, be addressed separately by adding shrapnel, lethal irritants, and additional explosives to these grenades.)

Figure 2:
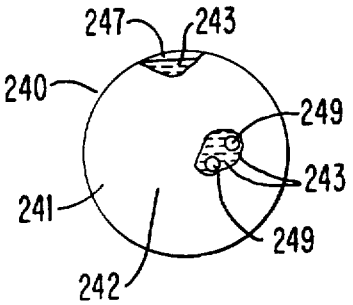
FIG. 2 is a diagrammatic view, partially broken away, of a typical capsule in accordance with the present invention.

The embodiments of FIG. 2 are capsules that are packed into the weapons of this invention. A typical capsule 240 compromises a frangible shell 241 that, depending on the compatibility of the shell material with the agents and/or irritants 243 contained therein, is a rigid material such as glass or plastic that shatters on impact, a more flexible material such as thin metal, rubber, paper, plastic, or combinations of these materials that rupture on impact, or are made to do so by introducing a weakened section such as optional score line 242. These shells, shown as spheres in FIG. 2, can have other shapes more suited to the shell material and/or the fill material 243 contained therein. Paper-metal composites, for example, are shell materials suitable for packaging lacquers, paints, solvents, abradants, and combinatins of these lens-compromising agents, but are easier to make as cylinders or cones than as spheres. Etchants, say hydrofluoric acid gels, would probably eat through paper-foil composites, but could be packaged in plastic film or film-lined paper. Glass, to cite a final example, is the material of choice when the capsules hold a volatile irritant, and glass capsules are more conveniently filled and sealed when shaped as ampules. Glass, however, is less suitable as a shell material when the filling is an etchant or abradant, regardless of shape.

The collection of lens-compromising agents is intended to compromise the kinds of lens material found in protective masks and in tank periscopes, night vision devices, and gunsights. These lenses are made of glass and/or plastic, and the etchants pit and roughen the glass lenses, the solvents soften the plastic lenses, and the abradants pit and roughen both, facilitating opaquing by, and adherence of, the lacquers or paints that, at least in the case of glass lenses, could otherwise be rubbed off with a solvent-moistened cloth.

These opaquing agents contain pigments and judicious choice of pigments makes these agents radar-compromising agents as well. Radar antennas are either exposed to the elements or protected by a radar-transparent shield. The latter arrangement is easily compromised by application of a commercially available electrically conductive paint via the capsules, and the former by a radar signal absorbing paint via the same means. One such radar absorbing paint is the aircraft coating material proposed by Stander, U.S. Pat. No. 3,599,210, in which a collection of conducting fibers turned to half a wavelength of the anticipated radar signals is embedded in a lossy medium. Other such paints are also known from "stealth" technology.

Figure 2A:
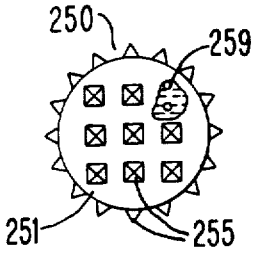
FIG. 2A is a diagrammatic view, partially broken away, of an abradant-surfaced capsule in accordance with this invention.

The embodiment of capsule 250 of FIG. 2A is an improved version of capsule 240, the improvement comprising abradant particles 255 affixed to and/or partially embedded into shell 251. Techniques for embedding and coating are well known from the prior art, an example of which is sandpaper manufacture.

Figure 2B:
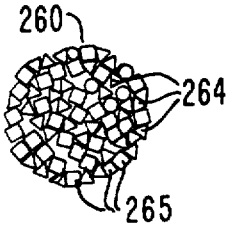
FIG. 2B is a diagrammatic view of a porous capsule in accordance with this invention.

The embodiment of "capsule" 260 of FIG. 2B is a weakly bonded porous assemblu of abradant particles 265. The fill material, say a paint, occupies the spaces 264 between these particles.

Figure 2C:
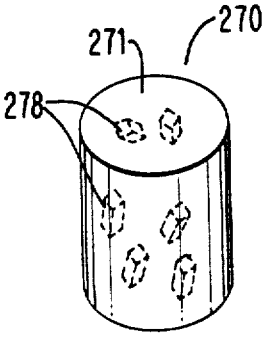
FIG. 2C is a diagrammatic view of an irritant-containing incendiary pellet in accordance with this invention.

The embodiment of "capsule" 270 of FIG. 2C is a pellet of incendiary material 271, embedded in which are smaller pellets 278 made of human irritants such as "CN", "CS", or "DM" that are vaporized when the incendiary material, ignited by the propelling charge or spontaneously by exposure to air, burns. When the incendiary material is a substance such as phosphorus that ignites spontaneously when exposed to air, obvious precautions must be taken to prevent such exposure before the grenades are detonated. Pellets 270, shown as cylinders in FIG. 2C, can, of course, have other shapes, such as the spheres shown in FIG. 3.

While the incendiary material 271 of pellets 270 can compromise plastic lenses, these pellets are preferably used in combination with capsules that can compromise glass lenses. One such combination is the pellet 270-capsule 250 arrangement of FIG. 3.

This description of preferred capsule embodiments is not intended to exhaust the subject, and other embodiments, say a modification of capsule 240 in which the fill material 243 is pressurized by a gas 247 or propelled by an impact-detonated material (not shown) are also considered to be within the scope of this invention, as are arrangements in which, for example, smaller capsules 249 and 259 are part of the fill material of capsules 240 and 250 respectively. These capsule-within-capsule arrangements not only make it possible to combine incompatible materials in the same capsule, but are also countermeasures to mesh-type lens guards as explained later herein.

The capsules of FIGS. 2, 2A, 2B, and 2C have been described with respect to shell and fill, but not with respect to size or to velocity at impact. Size is a compromise among such parameters as capsule strength, propelling charge force, coverage, range, and, in the case of tanks, momentum needed to overcome the effect of purge streams intended to deflect particles from lenses. One such purge stream arrangement is disclosed in Durer, U.S. Pat. No. 4,284,326.

Because modern tanks have top speeds approaching 100 feet per second, capsules should preferably have velocities well in excess of this so that they are also effective against rearward-facing tank periscopes. Capsules targeted toward the lenses of protective masks will, of course, be effective at lower velocities, and can compromise such lenses with smaller volumes of fill. Because the exact target cannot be known when a given grenade is made, capsules in each grenade preferably cover a range of sizes.

As presently preferred, capsules range from one to three eighths of an inch in diameter, but capsules outside this range are also effective. The capsules 249, 259 are, for example, smaller than the preferred range, but are effective because their momenta are preserved by the larger capsules in which they are contained.

If the weapons of this invention are to produce the effects described earlier, they must be effective despite countermeasures, one of which, disclosed by Durer, has been addressed.

A second countermeasure is the mesh-type lens guards mentioned earlier herein. These guards intercept larger capsules and reduce their contents to sprays so fine that purge streams can deflect them, but mesh fineness is limited because (as anyone who has tried to paint mosquito screening knows) fine mesh guards will be clogged by the opaquants of this invention and become vision obstructors instead of protectors for their respective lenses.

Capsules 249, 259, part of the fill material of larger capsules 240, 250 respectively, are transported to the mesh-type lens guards by the larger capsules, and if these larger capsules are broken by the guards, the smaller capsules released thereby, and small enough to pass through the mesh openings of these guards, arrive at their targets with enough momentum to resist the effect of purge streams and to compromise lenses as intended by this invention. These small capsules would not, however, so arrive if propelled as free capsules by the propelling charges of the weapon embodiments of this invention.

A third countermeasure, and one that can be field improvised, is a layer or two of transparent plastic film temporarily affixed over the lenses to intercept the lens-compromising agents, and removed to restore lens function. Capsules 250 not only address this countermeasure, but turn it into a weapon-enhancing advantage, the external portions of abradant particles 255 cutting through the film so that the capsules penetrate the film, spread their contents over the lenses, and are held there by the film. Capsules 250, however, are almost as effective against each other as they are against the lenses, and must be packed into the weapons in such a way that they do not abrade one another.

Pellets 270 are also effective against this film countermeasure, and are particularly so when the target lenses are made of plastic, because the incendiary material 271 not only burns through the film, but also burns the lenses. Pellets 270 can also, and if large enough will, burn through masks and protective clothing to deliver a concentrated dose of human irritant to combatants.

Figure 3:
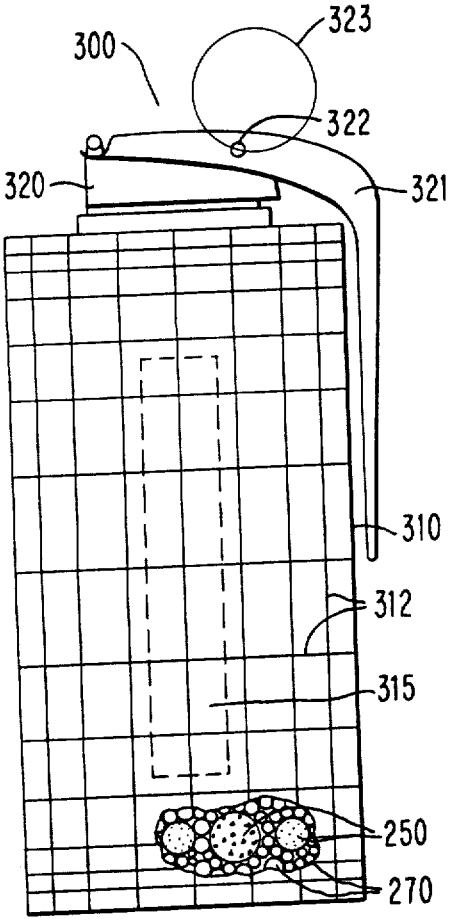
FIG. 3 is a diagrammatic view, partially broken away, of another grenade in accordance with this invention.

The embodiment of FIG. 3 is grenade 300, specifically intended for the capsules of this invention. Parts familiar from existing weapons and needing no further elaboration here include fly-off handle 321, safety pin 322, and pin ring 323. Body 310 of grenade 300 is preferably cylindrical, made of plastic, and grooved on its outer surface, grooves 312 facilitating gripping and throwing, and rupturing in such a way that the bulk of the capsules are propelled as intended.

Grenade 300 is preferably ignited by the U.S. Army M217 Fuse (presently fitted to the U.S. Army M68 Grenade) that ignites on the basis of both impact and time, the impact mechanism being armed a second or two after the grenade is thrown, and the timer igniting the grenade a few seconds later if the impact mechanism does not work first. This igniter 320 ignites propelling charge 315, say a charge of black powder mixed with a binder or packed in a paper or plastic tube, and such that the depth of capsules above, below, and radially outward from the charge is the same, resulting in a capsule dispersion pattern approximating omnidirectionality. Where there is a conflict between the preferred positioning of propelling charge 315 and the portion of igniter 320 that is inside body 310 and must be positioned to ignite that charge, the conflict can be resolved and the preferred capsule dispersion pattern preserved by changing to a tubular propelling charge configuration.

Grenade 300 is filled with one or more of the kinds of capsules of FIGS. 2, 2A, 2B, and 2C, and, as explained earlier herein, when at least some of these capsules have external abradants as do capsules 250, each such capsule must be isolated to protect the others.

The preferred isolation arrangement is that of the cut-away portion of FIG. 3, in which capsules 250 are alternated with pellets 270 in such a way that each of the capsules 250 is isolated from the others. This arrangement is, however, hard to manufacture, and especially so when pellets 270 are the kind that ignite spontaneously when exposed to air.

Figure 3A:
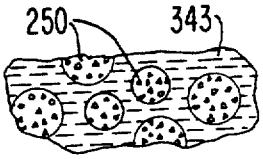
FIG. 3A is a diagrammatic view of the broken away portion of another embodiment of FIG. 3 illustrating another arrangement in accordance with this invention for isolating the abradant-surfaced capsules of this invention from one another.

The easiest arrangement to manufacture is that of FIG. 3A, in which capsules 250 are isolated from one another by isolating media 343 which are, for example, finely divided active or inert dry ingredients, viscous liquids, or gels.

Figure 3B:
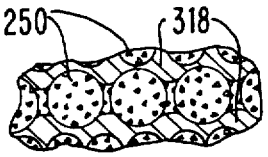
FIG. 3B is a diagrammatic view of the broken away portion of yet another embodiment of FIG. 3 illustrating yet another arrangement in accordance with this inventin for isolating the abradant-surfaced capsules of this invention from one another.

A third isolation arrangement is that of FIG. 3B, in which each capsule 250 is isolated from the others by waffle or egg-crate-like separators 318. These separators are preferably made of an active material such as magnesium, or a combination of active materials such as those of pellets 270.

Figure 4:
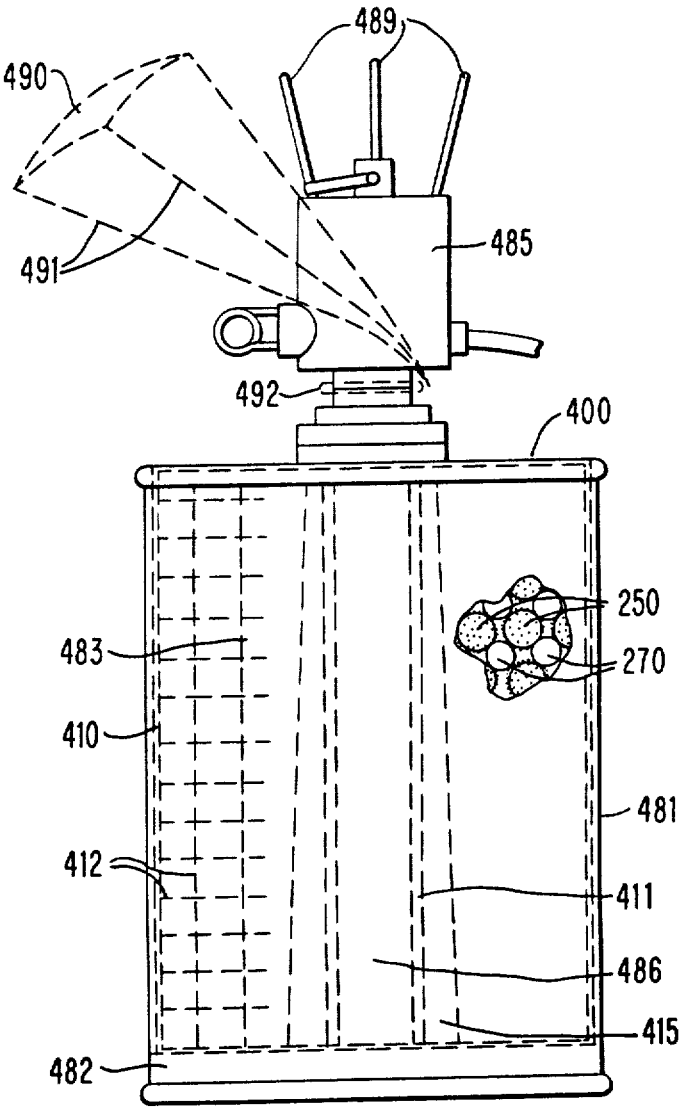
FIG. 4 is a diagrammatic view, partially broken away, of a bounding mine in accordance with this invention.

The embodiments of FIG. 3 can also be field-converted into (land) mines by securing them to, say pegs, poles, or trees, preferably at heights approximating those of their target lenses, and attaching trip lines to pin rings 323. Unfortunately, mines at these heights are easily spotted, and the mines of FIG. 4 are preferred because they can be hidden on or in the ground, but detonate at the more effective height. These FIG. 4 embodiments 480 are derived from the U.S. Army M16A1 Anti-personnel Bounding Mines and the grenades of FIG. 3 herein.

Components of the FIG. 4 embodiment familiar from the M16A1 mines are case 481, U.S. Army M605 Combination Fuse 485, and lifting charge 482. Projectile 483, which is propelled upward when lifting charge 482 is ignited by igniter 485, resembles the projectile of the M16A1 mines externally but is actually more like the grenades of FIG. 3, having a grooved body 410, antitank-antipersonnel material, preferably capsules 250 and pellets 270, propelling charge 415, and an igniter 485, preferably the U.S. Army M605 Combination Fuse shown. Because body 410 must withstand both the heat and the accelerating force of lifting charge 482, body 410 is preferably made of metal or other materials that can survive these effects. Grooves 412 that accommodate both the fragmentation of projectile body 410 and the dispersion of the antitank-antipersonnel material are preferably internal rather than external as on grenade 300 of FIG. 3, to avoid compromising the lifting charge 482.

Igniter 485 screws into projectile 483, and igniter hole 486, having a wall 411, preferably of the same material as body 410 but ungrooved and strong enough to survive the effects of lifting charge 482 and propelling charge 415, accommodates this and extends the full length of projectile 483 so that igniter 485 can ignite both lifting charge 482 and propelling charge 415, the former when pressure is applied to one (or more) of the three prongs 489 shown or to the igniter itself, or a trip wire (preferably arranged to start the detonation sequence as the target approaches the mine) pulls the release pin, and the latter when projectile 483 reaches the predetermined height.

Propelling charge 415 propels the lens-compromising agents contained in projectile 483 towards the target lenses, and does so most effectively when the deflecting effects of helmets and tank optics shields are addressed, i.e., when projectile 483 is detonated at a height slightly below these lenses, and the capsules 250 and pellets 270 (or lens-compromising agents otherwise contained) are given a slight upward component of velocity. The projectile is detonated at the preferred height as a result of the bounding feature copied from the M16A1 mine, and the upward component of velocity as a result of moving the center of force of propelling charge 415 slightly closer to the bottom of projectile 483.

The preferred dispersion patterns for the lens-compromising agents of the mine embodiments of FIG. 4 are thus different from those for the grenades of FIG. 3, and these changes in pattern are effected by distributing the preferably black powder propelling charges 415 as tubes of uniform bore extending the length of the interior of projectiles 483, but slightly thicker at the bottom than at the top. (This variation in thickness is exaggerated in the drawing.)

The primary weapons of this invention are the grenades of FIG. 3 and the mines of FIG. 4, and these grenades are intended to be thrown, and the mines sown, by hand. Other "delivery" devices have, however, been developed, and these include hand-held grenade launchers such as the U.S. Army M203PI, the "area denial" projectiles such as the U.S. Army 155 mm M483 (for grenades) and the M731 (for mines), the U.S. Army M56 Helicopter-delivered Scatterable Mine System, etc., and skilled art workers will recognize that the primary weapons of this invention can be made suitable for use in these delivery systems by, for example, changing the igniters 320 of FIG. 3 to those of the U.S. Army M42, M43, or M46 grenades, and by adding fins, tails, or the parachute-like drogues 490, connected by lines 491 attached to drogue ring 492, to the mines of FIG. 4 to keep their axes of symmetry vertical, modifying the fuses 485 of these mines so that they also ignite lifting charges 482 after a suitable time has elapsed, or changing to fuses that do.

When these delivery systems also combine lens-compromising agents, human irritants, and, where appropriate, radar-compromising agents synergistically as explained herein, or contain weapons that do, they are also weapons of this invention.

The weapons of this invention differ from those of the prior art in that their effects are cumulative, and are preferably used on that basis. As one example consider modern main battle tanks such as the U.S. Army M1. These tanks are impervious to most if not all of the most modern antitank weapons, and cannot be expected to be compromised by antipersonnel grenades or mines no matter how many are encountered. These tanks, however, not only can, but will be rendered defenseless by repeated assaults by the weapons of this invention.

Next, consider the foot soldier who can, if properly masked, continue to fight effectively despite repeated tear gas assaults, but cannot continue to do so when the tear gas is the human irritant in the weapons of this invention.

On the basis of these two examples it is clear that while the larger and more powerful mines conventionally used against tanks can be converted to weapons of this invention by substituting the capsules and propelling charges of this invention for the high explosive, fragmentation, and projectile material of those mines, the active materials of this invention are more effective as a collection of smaller weapons the total weight or volume of which is that of the original weapon.

Finally, there is the matter of separate delivery of the human irritants, the lens-compromising agents, and, where appropriate, the radar compromising agents of this invention. This matter is of particular importance not only because irritant-only grenades are a part of existing ordnance, but also because personnel rendered incapable of fighting by the preferred weapons of this invention can be so maintained by human irritants alone.

Logistics dictates weapons that deliver agents that compromise lenses, radars, and humans, one of the two exceptions being that stated previously herein, and the other the field-improvised anti-riot-weapon countermeasure comprising say a container of paint mixed with sand, affixed to or contained in which is a fused propelling charge, say a firecracker. This second exception, a weapon in accordance with this invention but without human irritants of its own, makes human-irritant-containing riot control weapons as effective in subduing the riot control forces as it is in subduing the rioters.

I claim:

1. An antitank-antipersonnel weapon comprising a housing, said housing containing at least one lens-compromising agent, a means for propelling said at least one lens-compromising agent toward the lenses of said tank and/or the lenses of the protective masks of said personnel, at least one human irritant, and a means for delivering said human irritant to within irritating proximity of said personnel.

2. The weapon of claim 1, wherein said at least one lens-compromising agent is an opaquant and an abradant, an etchant, an incendiary material, or a solvent.

3. The weapon of claim 1, wherein said at least one human irritant is "CN", "CS", or "DM".

4. The weapon of claim 1, wherein said at least one human irritant is a lethal gas, vapor, liquid, aerosol, or dust.

5. The weapon of claim 1, wherein said means for propelling said at least one lens-compromising agent toward said lenses and said means for delivering said human irritant to within irritating proximity of said personnel is a propelling charge.

6. The weapon of claim 1, wherein at least a portion of said at least one lens-compromising agent is packaged in capsules.

7. The capsules of claim 6, wherein at least a portion of said at least one lens-compromising agent packaged therein is packaged in smaller capsules.

8. The weapon of claim 1, further comprising at least one radar-compromising agent.

9. An antitank-antipersonnel weapon comprising at least two lens-compromising agents one of which is an opaquant, the other facilitating adherence of the opaquant to the lens surface, and a means for propelling said at least two lens-compromising agents toward the lenses of said tank and/or the lenses of the protective masks of said personnel.

10. The weapon of claim 9, wherein said means for propelling said at least two lens-compromising agents toward said lenses is a propelling charge.

11. The weapon of claim 9, wherein at least a portion of said at least two lens-compromising agents is packaged in capsules.

12. The capsules of claim 11, wherein at least a portion of said at least two lens-compromising agents packaged therein is packaged in smaller capsules.

13. The weapon of claim 9, further comprising at least one radar-compromising agent.

14. An antitank-antipersonnel weapon comprising a housing, said housing containing at least one lens-compromising agent, at least a portion of which is packaged in capsules, a means for propelling said at least one lens-compromising agent toward the lenses of said tank and/or the lenses of the protective masks of said personnel, at least one human irritant, and a means for delivering said human irritant to within irritating proximity of said personnel.

15. The weapon of claim 14, wherein at least a portion of said at least one lens-compromising agent packaged in said capsules is packaged in smaller capsules.

16. The weapon according to claim 14, wherein the contents of said capsules is pressurized.

17. The weapon according to claim 15, wherein the contents of said smaller capsules is pressurized.

18. An antitank-antipersonnel weapon comprising at least two lens-compromising agents at least one of which is an opaquant, at least a portion of each of said at least two lens-compromising agents being packaged in capsules, and a means for propelling said at least two lens-compromising agents toward the lenses of said tank and/or the lenses of the protective masks of said personnel.

19. The weapons of claim 18, wherein at least a portion of each of said at least two lens-compromising agents packaged in said capsules is packaged in smaller capsules.

20. The weapon of claim 18, wherein the contents of at least some of said capsules is pressurized.

21. The weapon of claim 19, wherein the contents of at least some of said smaller capsules is pressurized.

22. The weapon of claim 18, further comprising at least one human irritant, and means for delivering said human irritant to within irritating proximity of said personnel.

23. The weapon of claim 18, wherein the other lens compromising agent facilitates adherence of the opaquant to said lenses.

24. The weapon of claim 1, wherein at least a portion of said at least one lens-compromising agent or at least a portion of said at least one human irritant is packaged in capsules, and wherein the contents of at least some of said capsules is pressurized.

25. The weapon of claim 24, wherein at least a portion of said lens compromising agent and at least a portion of said human irritant are packaged in capsules.

* * * * *

UNITED STATES PATENT AND TRADEMARK OFFICE

CERTIFICATE OF CORRECTION

PATENT NO. : 4,976,202

DATED : Dec. 11, 1990

INVENTOR(S) : Richard F. Honigsbaum

It is certified that error appears in the above-indentified patent and that said Letters Patent is hereby corrected as shown below:

Column 4, line 42, delete "assemblu" and insert --assembly--

Add drawing Figures 1, 2, 2A, 2B, 2C, 3, 3A, 3B and 4 as per attached.

On title page, "25 Claims, No Drawings" should read --25 Claims, 4 Drawings--

Signed and Sealed this

Twenty-fourth Day of May, 1994

Bruce Lehman

*Attest:*

BRUCE LEHMAN

*Attesting Officer*

*Commissioner of Patents and Trademarks*

1/4

2/4

3/4

4/4